US006692880B2

(12) United States Patent
Fields et al.

(10) Patent No.: US 6,692,880 B2
(45) Date of Patent: Feb. 17, 2004

(54) ELECTROPHOTOGRAPHIC TONER WITH STABLE TRIBOELECTRIC PROPERTIES

(75) Inventors: Robert D. Fields, Rochester, NY (US); Dinesh Tyagi, Fairport, NY (US); John C. Wilson, Rochester, NY (US); Peter Alexandrovich, Rochester, NY (US); Robert Guistina, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/139,782

(22) Filed: May 6, 2002

(65) Prior Publication Data

US 2003/0073017 A1 Apr. 17, 2003

Related U.S. Application Data

(60) Provisional application No. 60/290,707, filed on May 14, 2001.

(51) Int. Cl.[7] ..... G03G 9/097; G03G 13/09

(52) U.S. Cl. ..... 430/108.1; 430/108.3; 430/108.4; 430/108.5; 430/111.41; 430/122

(58) Field of Search ..... 430/108.1, 108.2, 430/108.3, 108.4, 108.5, 111.41, 122

(56) References Cited

U.S. PATENT DOCUMENTS

| | | | | |
|---|---|---|---|---|
| 2,229,513 A | | 1/1941 | Lustig et al. | 217/60 |
| 3,716,630 A | | 2/1973 | Shirk | 423/594 |
| 3,893,935 A | | 7/1975 | Jadwin et al. | 252/62.1 |
| 3,941,898 A | | 3/1976 | Sadamatsu et al. | 427/18 |
| 3,983,992 A | | 10/1976 | Gray et al. | 198/381 |
| 4,046,990 A | | 9/1977 | White | 219/471 |
| 4,076,857 A | | 2/1978 | Kasper et al. | 427/18 |
| 4,079,014 A | | 3/1978 | Burness et al. | 252/62.1 |
| 4,085,702 A | | 4/1978 | Consaul et al. | 118/60 |
| 4,160,644 A | | 7/1979 | Ryan | 23/230 B |
| 4,323,634 A | | 4/1982 | Jadwin | 430/110 |
| RE31,072 E | | 11/1982 | Jadwin et al. | |
| 4,385,823 A | | 5/1983 | Kasper et al. | 430/60 |
| 4,394,430 A | | 7/1983 | Jadwin et al. | 430/110 |
| 4,395,109 A | | 7/1983 | Nakajima et al. | 355/3 FU |
| 4,414,152 A | | 11/1983 | Santilli et al. | 260/185 |
| 4,416,965 A | | 11/1983 | Sandhu et al. | 430/109 |
| 4,430,408 A | | 2/1984 | Sitaramiah | 430/106.6 |
| 4,473,029 A | | 9/1984 | Fritz et al. | 118/657 |
| 4,515,884 A | | 5/1985 | Field et al. | 430/99 |
| 4,546,060 A | | 10/1985 | Miskinis et al. | 430/108 |
| 4,624,907 A | | 11/1986 | Niimura et al. | 430/106 |
| 4,683,188 A | | 7/1987 | Suzuki et al. | 430/110 |
| 4,762,763 A | | 8/1988 | Nomura et al. | 430/110 |
| 4,780,553 A | | 10/1988 | Suzuki et al. | 556/26 |
| 4,810,858 A | | 3/1989 | Urban et al. | 219/469 |
| 4,814,250 A | | 3/1989 | Kwarta et al. | 430/110 |
| 4,834,920 A | | 5/1989 | Bugner et al. | 260/201.15 |
| 4,840,864 A | | 6/1989 | Bugner et al. | 430/110 |
| 4,912,009 A | | 3/1990 | Amering et al. | 430/137 |
| 5,057,392 A | | 10/1991 | McCabe et al. | 430/109 |
| 5,089,547 A | | 2/1992 | McCabe et al. | 524/262 |
| 5,102,765 A | | 4/1992 | McCabe et al. | 430/110 |
| 5,112,715 A | | 5/1992 | DeMejo et al. | 430/109 |
| 5,120,631 A | | 6/1992 | Kanbayashi et al. | 430/106 |
| 5,147,747 A | | 9/1992 | Wilson et al. | 430/109 |
| 5,480,757 A | * | 1/1996 | Jadwin et al. | 430/110 |
| 5,534,347 A | | 7/1996 | Chen et al. | 428/375 |
| 5,595,823 A | | 1/1997 | Chen et al. | 428/906 |
| 5,629,061 A | | 5/1997 | Kass | 428/35.8 |
| 5,665,512 A | * | 9/1997 | Tsutsui et al. | 430/110 |
| 5,714,295 A | | 2/1998 | Wilson et al. | 430/110 |
| 5,780,195 A | | 7/1998 | Nava | 430/110 |
| 6,067,438 A | | 5/2000 | Chen et al. | 399/325 |
| 6,096,429 A | | 8/2000 | Chen et al. | 428/421 |
| 6,562,535 B1 | * | 5/2003 | Masuo et al. | 430/108.22 |

FOREIGN PATENT DOCUMENTS

| | | | |
|---|---|---|---|
| EP | 3905 | 1/1976 | C08K/5/19 |
| GB | 1501065 | 2/1978 | G03G/9/08 |
| GB | 1420839 | 9/1979 | C08J/3/02 |

* cited by examiner

*Primary Examiner*—John Goodrow

(57) ABSTRACT

Toner formulations and developers containing the toner formulations are described. The toner contains at least one toner resin, at least one first charge control agent capable of providing a consistent level of charge, at least one second charge control agent capable of providing a sustained level of charge, at least one surface treatment agent, and at least one release agent and optionally at least one colorant. The toners of the present invention preferably provide a consistent level of charge of from about −10 to about −30 micro C/gm and also provide this level of charge for a sustained period of time, such as from about 2 to about 10 minutes. The toners of the present invention also provides excellent ruboff values for an image printed from the toners of the present invention. Methods of improving ruboff are described as well as methods to develop an image using the toner of the present invention.

56 Claims, No Drawings

ELECTROPHOTOGRAPHIC TONER WITH STABLE TRIBOELECTRIC PROPERTIES

This application claims the benefit under 35 U.S.C. §119(e) of prior U.S. Provisional Patent Application No. 60/290,707 filed May 14, 2001, which is incorporated in its entirety by reference herein.

BACKGROUND OF THE INVENTION

The present invention relates to electrophotographic toners. More particularly, the present invention relates to electrophotographic toners having stable triboelectric properties and methods of printing images using these toners.

The image quality currently available is generally good in that prints have high solid area reflection density, low background in non-image areas, and consistent print quality from toner lot to toner lot and from the start of a new developer until it is replaced. The present toners, however, are not as good with respect to fusing quality and toner ruboff (e.g., the abrasion resistance of the fused image).

In attempting to improve toner ruboff, a wax, for instance, can be included in the toner. However, waxes can effect triboelectric properties of a toner. If the triboelectric properties are increased, the resulting prints may look gray because less toner is being transferred onto the paper. In addition, the toners may not be as free flowing as desired.

Accordingly, new toner formulations which provide an improved or reduced ruboff without affecting the charge and/or flow properties would be beneficial to those in the industry.

SUMMARY OF THE PRESENT INVENTION

A feature of the present invention is to provide an electrophotographic toner having stable triboelectric properties.

Another feature of the present invention is to provide a toner formulation that has improved ruboff properties.

A further feature of the present invention is to provide an electrophotographic toner formulation that reduces ruboff and yet provides satisfactory charge and/or flow properties.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

To achieve these and other advantages and in accordance with the purposes of the present invention as embodied and broadly described herein, the present invention relates to a toner formulation containing at least one toner resin, at least one first charge control agent capable of providing a consistent or controllable level of charge, at least one second control agent capable of providing a sustained level of charge, and optionally at least one surface treatment agent, and optionally at least one release agent, and optionally at least one colorant.

The present invention further relates to a method of decreasing toner ruboff on an image and involves printing an image on a substrate using the above-identified toner formulation of the present invention.

It is to be understood that both the foregoing general description and the following detailed description are exemplary and explanatory only and are intended to provide a further explanation of the present invention, as claimed.

DETAILED DESCRIPTION OF THE PRESENT INVENTION

The present invention relates to toner formulations preferably having stable triboelectric properties and also preferably having acceptable toner ruboff properties. Further, preferably the toner formulations of the present invention are free flowing. In more detail, the toner formulations of the present invention contain at least one toner resin, at least one first charge control agent capable of providing a consistent level of charge and at least one second charge control agent capable of providing a sustained level of charge. The toner formulation preferably further contains at least one surface treatment agent which is optional and optionally at least one release agent. Optionally, the toner formulation can contain at least one colorant and other conventional components typically found in toner formulations.

The toner formulations of the present invention can be used in single component toners or two component toners. Preferably, the toner formulations of the present invention are used in two component toner/developer systems.

In the present invention, the toner resin can be any conventional polymeric resin or combination of resins typically used in toner formulations using conventional amounts.

The toner particles can include one or more toner resins which can be optionally colored by one or more colorants by compounding the resin(s) with at least one colorant and any other ingredients. Although coloring is optional, normally a colorant is included and can be any of the materials mentioned in *Colour Index,* Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Typically, the amount of toner resin present in the toner formulation is from about 85 to about 95% by weight of the toner formulation.

The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

With respect to the first charge control agent, as indicated above, one or more different types of first charge control agents can be used. The first charge control agent is capable of providing a consistent level of charge (e.g., controllable level of charge). The first charge control agent has the ability to "dial in" the desired charge level. For purposes of the present invention, a preferred consistent level of charge is from about −10 to about −30 micro C/gm. The toner Q/m ratio can be measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram ($\mu$C/g) is calculated by dividing the accumulated charge by the mass of the deposited toner taken from the upper plate.

Examples of suitable first charge control agents include, but are not limited to, acidic organic charge control agents. Particular examples include, but are not limited to, 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived therefrom. Other examples include charge control agents with one or more acidic functional groups, such as fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N—(3,5-di-t-butyl-4-hydroxybenzoyl)-4-chlorobenzenesulfonamide and 1,2-benzisothiazol-3(2H)-one 1,1-dioxide.

The first charge control agent is generally present in the toner formulation in an amount to provide a consistent or controllable level of charge and preferably provide a consistent level of charge of from about −10 to about −30 micro C/gm in the toner formulation upon being charged. This level is especially preferred when the toner particle size is large, such as from about 10 microns to about 12 microns. Examples of suitable amounts include from about ½ part to about 3 parts per 100 parts of resin present in the toner formulation. Other preferred ranges for the consistent level of charge include from about −30 to about −120 micro C/gm in the toner formulation upon being charged. This is especially preferred when the toner particle size is small, such as from about 4 microns to about 8 microns.

Any acidic material having a pKa in the range of from about 2 to about 8 can be used as the first charge control agent. Acidic materials with pKa values of from 3 to 7 are particularly preferred. Acidic materials preferably contain a labile proton, such as a carboxylic, phenolic or sulfonic acid. More broadly an acid also includes compounds within the definition as proposed by G. N. Lewis, that is an acid is any material capable of accepting an electron pair from a donor molecule. The term pKa is defined as $$pKa = -\log(Ka)$$

where Ka is an inherent molecular property of an acidic compound and is called the acid dissociation constant. Ka is defined by the following equation;

$$Ka = \frac{[H^+][B^-]}{[HB]}$$

In a practical sense the lower the pKa value the stronger the acid. Acids useful in this invention may have more than one acid function per molecule such as di- and tri-carboxylic or di- and tri-sulfonic acids. Further, multiple types of acid functional groups may be present in the useful molecule for example as in p-carboxybenzenesulfonic acid. One skilled in the art can readily propose other such acids based on the foregoing definitions. Some monomeric acids useful in this invention along with their pKa values are given in Table 1.

TABLE 1

Useful Acids and Their pKa Values

| Acid | pKa 1 | pKa 2 |
|---|---|---|
| MPP | 6.6 (a) | |
| maleic | 2.0 | 6.2 |
| fumaric | 3.0 | 4.4 |
| adipic | 4.5 | 5.4 |
| terephthalic | 3.5 | 4.4 |
| salicylic | 3.0 | |
| fumaric acid monoethyl ester | 3.5 (a) | |
| methylene di-salicylic | 3.0 | 3.2 |
| 3,5-di-t-butylsalicylic | 3.5 | |
| 3,5-di-t-butylbenzoic | 4.6 | |
| benzoic | 4.2 | |
| malonic | 2.9 | 5.7 |
| succinic | 4.2 | 5.4 |
| glutaric | 4.3 | 5.4 |
| isophthalic | 3.6 | 4.6 |
| phthalic | 3.0 | 5.4 |

(a) values measured by titrimetry.
All other values were obtained or extrapolated from tables in Morrison and Boyd, Organic Chemistry, 2nd edition, Allyn and Bacon, Boston, 1966.

With respect to the second charge control agent, one or more different types of second charge control agents can be used. The second charge control agent is capable of providing a sustained level of charge (e.g., stable level of charge) in the toner formulation. Preferably, a sustained level of charge is a triboelectric charge in the toner formulation that is sustained over time. For example and as shown in the Examples, for purposes of the present invention, preferably the second charge control agent(s) maintains a toner triboelectric charge of from about −10 to about −30 micro C/gm for a time period of from 2 minutes to 10 minutes. This sustained level of charge is especially preferred when the toner particle size is large, such as from about 10 microns to about 12 microns. Other preferred sustained levels of charge include from about −30 to about −120 micro C/gm in the toner formulation. This is especially preferred when the toner particle is small, such as from about 4 microns to about 8 microns. The sustained level of charge is measured by measuring the toner triboelectric charge in a developer mixture that has been agitated for 2 minutes and for 10 minutes.

A preferred class of second charge control agents include, but are not limited to, iron organo metal complexes such as organo iron complexes. A particular example is T77 from Hodogaya. The second charge control agent is generally present in the toner formulation in an amount such that the triboelectric charges in the toner are sustained for a period of from 2 minutes to 10 minutes within the range of −10 to −30 micro C/gm or from about −30 to about −120 micro C/gm. Other examples include metal salts of salicylic acid and metal salts of salicylic acid derivatives. Specific examples are set forth in U.S. Pat. No. 4,762,763, incorporated herein by reference. Examples of suitable amounts of the second charge control agent include, but are not limited to, from about ½ part to about 3 parts per 100 parts of toner resin in the toner formulation.

In the present invention, in some embodiments, at least one release agent is preferably present in the toner formulation. An example of a suitable release agent is one or more waxes. Useful release agents are well known in this art. Useful release agents include low molecular weight polypropylene, natural waxes, low molecular weight synthetic polymer waxes, commonly accepted release agents, such as stearic acid and salts thereof, and others.

The wax is preferably present in an amount of from about 0.1 to about 10 wt % and more preferably in an amount of from about 1 to about 6 wt % based on the toner weight. Examples of suitable waxes include, but are not limited to, polyolefin waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as Polywax 2000, Polywax 3000, and/or Unicid 700; and waxes from Sanyo Chemical Industries such as Viscol 550P and/or Viscol 660P. Other examples of suitable waxes include waxes such as Licowax PE130 from Clarient Corporation.

With respect to the surface treatment agent also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 5 weight percent, and more preferably from about 0.1 to about 3 weight percent, and most preferably from about 0.2 to 0.6 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 $\mu$m in diameter (more preferably about 0.1 $\mu$m), such as acrylic polymers, silicone-based polymers, styrenic polymers, fluoropolymers, copolymers thereof, and mixtures thereof.

When the toner formulation of the present invention is used in a two-component toner, the carrier particles used in association with the toner formulation can be conventional carrier particles. Thus, the carrier particles can be hard or soft magnetic carrier particles. With a two component developer, the toner concentration of the present invention is preferably present in an amount of from about 1 wt % to about 25 wt %, and more preferably from about 3 wt % to about 12 wt % based on the weight of the developer.

In more detail, the set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No. 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The polymer may be made using a limited coalescence reaction such as the suspension polymerization procedure disclosed in U.S. Pat. No. 4,912,009 to Amering et al., which is incorporated in its entirety by reference herein.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders.

Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols. Other useful resins include polyester resins, such as by the co-polycondensation polymerization of a carboxylic acid component comprising a carboxylic acid having two or more valencies, an acid anhydride thereof or a lower alkyl ester thereof (e.g., fumaric acid, maleic acid, maleic anhydride, phthalic acid, terephthalic acid, trimellitic acid, or pyromellitic acid), using as a diol component a bisphenol derivative or a substituted compound thereof. Specific examples are described in U.S. Pat. Nos. 5,120,631; 4,430,408; and 5,714,295, all incorporated herein by reference, and include propoxylated bisphenol—A fumarate, such as Finetone® 382 ES from Reichold Chemicals, formerly Atlac® 382 ES from ICI Americas Inc.

A useful binder can also be formed from a copolymer of a vinyl aromatic monomer; a second monomer selected from either conjugated diene monomers or acylate monomers such as alkyl acrylate and alkyl methacrylate.

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain one or more other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and poly (vinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

When the toner formulation of the present invention is used in a single component toner system, the toner formulation has present charging particles as well, such as negatively charging particles. The amount of the charging particles for the single component optional system are conventional amounts. When a single component system is used, preferably the charging particles are at least one type of magnetic additive or material, such as soft iron oxide which is dispersed in the toner. Examples of useful charging particles include mixed oxides of iron, iron silicon alloys, iron aluminum, iron aluminum silicon, nickel iron molybdenum, chromium iron, iron nickel copper, iron cobalt, oxides of iron and magnetite. Other suitable magnetic materials that can be present in the toner include, but are not limited to, magnetic material containing acicular magnetites, cubical magnetites, and polyhedral magnetites. A useful soft iron oxide is TMB1120 from Magnox Inc.

The toner formulations of the present invention can also be used in magnetic image character recognition (MICR). In such an application, the amount of the magnetic material in the toner particles of the present invention can be any amount sufficient to preferably meet commercial needs, such as providing a sufficient signal strength for the toners developed as an image. Preferably, the amount of magnetic loading in the toner compositions is from about 40% to about 50% by weight of the toner particles, and more preferably from about 42% to about 45% by weight of the toner particles though other amounts can be used. The toner preferably comprises, based on the weight of the toner, from about 40 to about 60 wt % polymer; from about 30 to about 55 wt % magnetic additive or material; optionally from about 1 to about 5 wt % release agent; and the preferred concentrations of silicon dioxide described above, all based on the weight of the toner.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

Developers in the development system of the present invention are preferably capable of delivering toner to a charged image at high rates and hence are particularly suited to high-volume electrophotographic printing applications and copying applications.

The present invention can be further clarified by the following examples, which are intended to be purely exemplary of the present invention.

Rub-Off Procedure

The test apparatus for measuring rub-off from an image-bearing substrate having a first side and a second side with a toner image on the first side has a flat surface having a first and second end and adapted to support a first substrate with one of its ends extending beyond the first end of the flat surface (test sheet); a restrainer for preventing movement of the second substrate (receiver sheet) along the length of the flat surface; a pressure pad adapted to impose a selected pressure on the first substrate and the second substrate in a test area; a puller adapted to pull the first substrate a selected distance through the test area relative to the second substrate; a calibrated scanner; and, a computer program for converting the scanned results into a numerical test results. The test sheet is positioned with its first side against the receiver substrate. Any apparatus which is effective to move the image-bearing side of the test sheet an effective distance through a test area relative to the receiver sheet and in contact with the receiver sheet at a selected pressure is suitable.

The substrates tested are typically paper sheets. The test sheet is a paper sheet bearing on its first side a toner image. This sheet is positioned so that one of its ends extends beyond the first end of the flat surface for engagement and removal therefrom. The second sheet is then placed over the first sheet and fastened to restrain its movement relative to the flat surface. A pressure is then imposed on a test area typically near the first end of the flat surface. The first sheet is then pulled from the flat surface and the resulting toner rub-off in the test area is indicative of the rub-off from the test sheet.

Such an apparatus and test procedure are disclosed in U.S. patent application No. (unassigned), entitled "Rub-off Test Method and Apparatus," filed Mar. 13, 2001 by John R. Lawson, Gerard Darby II, and Joseph A. Basile, with Attorney Docket No. HEID-25,491, and this application is incorporated in its entirety by reference herein.

The test apparatus is designed to move the test sheet through a test area subject to a test pressure for a selected distance relative to the receiver sheet to determine the rub-off tendencies of the test sheet. It will be understood that the apparatus could operate with the test sheet above the receiver sheet so long as the test sheet is moved relative to the receiver sheet.

The measurement of rub-off is accomplished in two steps. The first step is to abrade the test sheet images on a suitable apparatus. The second step is to take the results of the abrasion test and analyze the results to obtain a quantitative measure of the rub-off characteristics of the test sheet.

The first step of generating the test sheets is accomplished by producing the test sheets on the system to be evaluated. The test prints for rub-off are desirably made up with text printed over the entire imaging area of an 8.5×11 inches sheet. A representative test sheet (target) is prepared. Desirably, the text is written on the test sheet at a suitable angle (i.e., seven degrees) relative to the horizontal. This is to eliminate streaks in the final image where breaks between words exist. In typical use, this target is rendered as a postscript file and sent to the printer. The printer then uses this input file to generate test sheets for evaluation under specific test conditions. Typically a standard paper, such as Hammermill Bond, is used for test-to-test consistency.

Once the test sheets have been made on the printer under study, the evaluation samples are made. These are generated by rubbing the test sheets (Hammermill Bond or any other standard paper) against the receiver sheets in a controlled manner. This control is obtained through the use of the apparatus described above To use the apparatus, the following steps are followed:

1. The test sheet is placed on the flat surface, face up. The sheet is aligned to a registration mark so that the leading edge of the test sheet protrudes beyond the first end of the flat surface.
2. The receiver sheet (second sheet) is placed on the test sheet. The receiver sheet is aligned with the first end of the flat surface. The other end of the receiver sheet is clamped in place.
3. A known weight is then placed in a holder and rests on the paper stack. The weight provides a known pressure on the stack in a test area. In these experiments, 3PSI was used.

4. The flat surface is then moved laterally until the leading edge of the test sheet engages a roller nip. The rollers turn and "grab" the test sheet and pull it out from under the receiver sheet at 21 inches per second. The relative motion between the test sheet and the receiver sheet causes the toner from the test print to be abraded by the receiver sheet in the test area. This results in a "toner smear" image on the receiver sheet. The level of "smearing" in the test area has been shown to correlate with the subjective measure of rub-off.
5. Steps 1 to 4 are repeated six times. The replicates may be handled in one of two ways. In the first method all six replicates are done with a selected pressure from about 0.5 to about 5 pounds per square inch (PSI). In the second method, two samples are made at each of three pressures, such as 1, 2, and 3 PSI. The differences in the analysis of the two methods are given in the next section.

To analyze the test sheets, the following procedure is followed:

1. Each test area is scanned on a calibrated scanner. The scanner is calibrated as follows:
   a) a step tablet of known density is scanned using the same scan conditions as used when the print is scanned;
   b) the contrast and zero point of the scanner are adjusted so that the digital values for the step tablets are at a predetermined value, within limits; and,
   c) the values of the step tablet are periodically checked when doing many scans (e.g., once an hour).
2. With the calibrated scanner, the six images from each test area are scanned. The scan options are selected to give the six scanned test areas sequential names. The scans are 230×230 pixels at 600 dots per inch in grayscale mode. The scanned test area is stored on the file server.
3. The data in the scanned files represent the luminance of the pixels in the scanned area. 0=black and 255=white. For each test area, the standard deviation of the luminance values is calculated. Standard deviation has been shown to provide a measure with a good signal-to-noise ratio that correlates with subjective evaluations of rub-off.
4. If all six test areas were made using the same weight, the standard deviation values for luminance are averaged and the average value is reported as the rub-off for the sample under test.
5. If the six test areas are made using three weights, the six standard deviation values are regressed against the pressures at which they were tested. A least squares regression curve, preferably a second order linear regression, is fit through this data and the estimated values for rub-off at predetermined pressures are calculated. These rub-off values as a function of pressure are the results reported for the test.
6. Confidence limits on the reported values are calculated for both data analysis methods and are typically +/−10% of the rub-off value.

A wide variety of apparatus can be used to maintain a pressure pad bearing a weight to produce the desired pressure in the test area in position. Basically, the pressure pad must be maintained in position so that it can exert the desired pressure on the top of the second sheet while being retained in position relative to the flat surface when either of the sheets is moved. This is can be accomplished by a variety of mechanical configurations. Such variations are obvious to those skilled in the art.

EXAMPLES

Example 1

A toner formulation was made from the following components:

TABLE 2

| Chemical | Trade name | Manufacturer | Weight % |
|---|---|---|---|
| Crosslinked styrene butyl acrylate copolymer | SB77XL | Eastman Kodak | 88.9 |
| Carbon Black | Black Pearls 430 | Cabot Corp | 6.2 |
| Polyethylene wax | Licowax PE130 | Clarient | 1.8 |
| Iron organic chelate charge control agent | T77 | Hodogaya | |
| MPP Acidic organic charge control agent | M25940 | Pfaltz and Bauer | 1.8 |

The components were dry powder blended in a 40 liter Henschel mixer for 60 seconds at 1000 RPM to produce a homogeneous blend. The powder blend was then melt compounded in a twin screw co-rotating extruder to melt the polymer binder and disperse the pigments, charge agents, and waxes. Melt compounding was done at a temperature of 230° F. at the extruder inlet, 230° F. increasing to 385° F. in the extruder compounding zones, and 385° F. at the extruder die outlet. The processing conditions were a powder blend feed rate of 10 kg/hr and an extruder screw speed of 490 RPM. The cooled extrudate was then chopped to approximately ⅛ inch size granules.

After melt compounding, the granules were then fine ground in an air jet mill to a particle size of 11 micron median, volume weighted, diameter. The toner particle size distribution was measured with a Coulter Counter Multisizer. The fine ground toner was then classified in a centrifugal air classifier to remove very small toner particles and toner fines that were not desired in the finished toner. After classification to remove fine particles, the toner had a particle size distribution with a width, expressed as the diameter at the 50% percentile/diameter at the 16% percentile of the cumulative particle number versus particle diameter, of 1.30 to 1.35.

The classified toner was then surface treated with fumed silica. A hyrdophobic silica, designated R972, and manufactured by Nippon Aerosil was used. 2000 grams of toner were mixed with 10 grams of silica to give a product containing 0.5 weight percent silica. The toner and silica were mixed in a 10 liter Henschel mixer with a 4 element impeller for 2 minutes at 2000 RPM.

The silica surface treated toner was sieved through a 230 mesh vibratory sieve to remove un-dispersed silica agglomerates and any toner flakes that may have formed during the surface treatment process.

In the examples, the time dependent charge response of the toner triboelectric charge was measured in a developer mixture that has been agitated for 2 minutes and 10 minutes. The toner triboelectric charge was measured by the MECCA device described earlier. Toner admix "throw-off" is a measure of low charging toner in a developer that can create background on a print. "Throw-off" (T-O), is measured by adding replenishment toner to an operating developer station and then capturing and weighing the toner that is expelled from the station as airborne dust. T-O values less than 10 mg are preferred and the lower the number the better.

Table 3 provides a summary of various formulations that were tested for triboelectric charges and the stability of these charges as well as toner throw-off.

TABLE 3

Formulation Latitude of SB77XL/T77/MPP/PE130/R972

| | | CCA | | Wax | | Surface Treatment | | −Q/m, offline | | |
|---|---|---|---|---|---|---|---|---|---|---|
| Example | Polymer | CCA | pph | Wax | pph | Type | % | 2' | 10' | T-O |
| 1 | SB77XL | T77 | 1.5 | None | | None | | 17.0 | 28.0 | 2.5 |
| 2 | SB77XL | T77 | 1.5 | PE130 | 1.0 | None | | 17.0 | 40.0 | 7.1 |
| 3 | SB77XL | T77/MPP | 1.5/2.0 | PE130 | 2.0 | None | | 9.1 | 14.4 | 11.6 |
| 4 | SB77XL | T77/MPP | 1.5/2.0 | PE130 | 2.0 | R972 | 0.10 | 12.1 | 15.7 | 6.4 |
| 5 | SB77XL | T77/MPP | 1.5/2.0 | PE130 | 2.0 | R972 | 0.20 | 13.7 | 16.9 | 4.2 |
| 6 | SB77XL | T77/MPP | 1.5/2.0 | PE130 | 2.0 | R972 | 0.30 | 16.8 | 19.4 | 3.1 |
| 7 | SB77XL | T77/MPP | 1.5/1.0 | PE130 | 2.0 | R972 | 0.05 | 22.0 | 36.0 | 1.8 |
| 8 | SB77XL | T77/MPP | 1.5/1.0 | PE130 | 2.0 | R972 | 0.10 | 27.0 | 37.0 | 1.4 |
| 9 | SB77XL | T77/MPP | 1.5/1.0 | PE130 | 2.0 | R972 | 0.20 | 26.0 | 36.0 | 0.9 |

From the Table, the following observations can be made.

Toner ruboff was improved by adding wax to the toner formulation. In this case a polethylene wax, Licowax PE130, was used. Although ruboff was improved, the addition of wax raises the absolute toner charge level. Example 1, containing no polyethylene wax, has 2' and 10' charge values of −17.0 and −28.0 $\mu$C/gm, within the desired range of −10 to −30 mC/gm. Example 2 with 1 pph of polyethylene wax has a 10' charge value of −40 uc/gm, outside the desired charge range. The addition of wax also made the toner powder more cohesive and poor powder flow properties. Free flowing toner powders are preferred to empty toner cartridges into a developer station and control toner replenishment rate to the developer station as toner is consumed. To improve the powder flow properties of the polyethylene wax containing toners, the toner was surface treated by blending toner with fumed hydrophobic silica, Degussa R972.

Table 3 summarizes the triboelectric charge and "throw-off" of a toner with good charging properties but poor ruboff, Example 1, and toners that have been made with polyethylene wax to improve ruboff and a combination of charge agents to achieve good triboelectric properties. Example 2 has wax added to improve ruboff, but has a high 10' charge value and a higher throw-off value than Example 1. Examples 7, 8, and 9 contained a mixture of two charge control agents (CCA), T77 at 1.5 pph and MPP at 1.0 pph. The 10' charge level was lower than Example 2, but not within the desired range of −10 to −30. The T-O values were low, better than both the control Example 1 and Example 2. Examples 3, 4, 5, and 6 also contained a mixture of two CCA's, T77 at 1.5 pph, and MPP at 2.0 pph and a varying level, 0.1 to 0.30 weight percent silica surface treatment. The 10' charge level for all these toners fell within the desired range of −10 to −30 uC/gm. Example 3 had no silica surface treatment and a 2' charge level below the −10 and a throw-off level higher than 10, both outside the desired range. The addition of silica surface treatment increased the 2' charge level and reduced the T-O level to bring these values within the desired ranges. Examples 4, 5, and 6 all had charge levels and T-O values with the desired range.

Toner ruboff values for certain examples were also tested. In particular, Example 1 had a toner 3 PSI ruboff value of from about 15 to 20. Example 5 had a rub-off value of from 4 to 7 which was significantly lower than the commercially available toner formulations.

The toner formulations of the present invention had a consistent level of charge and a sustained level of charge along with excellent ruboff properties and excellent flowability. Accordingly, a balance of properties was achieved with the toner formulations of the present invention.

Example 2

Polyester toner binder resins of varying composition were obtained from the Kao Corporation of Minato Wakayama, Japan. Table 4 summarizes the acid content properties of these materials. The acid number was determined by titration (mg KOH per g to neutralize the sample); the monomeric acid contents were determined by gas chromatography. The Binder C material in particular contains a fairly high concentration of acidic materials in the monomer state, about 0.2 weight % of an approximately 50/50 mixture of maleic and fumaric acids, corresponding to approximately 10% of the entire titrated acid value being due to monomeric acids.

TABLE 4

Polyester resins

| Resin | Acid Number | Monomeric acid Weight % | Identity of Monomeric Acids |
|---|---|---|---|
| Binder C | 20 | 0.2% | fumaric, maleic |
| Binder I | 32 | 0.01% | isophthalic |

TABLE 4-continued

| Polyester resins | | | |
|---|---|---|---|
| Resin | Acid Number | Monomeric acid Weight % | Identity of Monomeric Acids |
| Binder A | 12 | 0.06% | fumaric, maleic |
| LLT-101 | 2 | Not detected | |

Table 5 describes the results of an experiment where additional fumaric acid was added to toners prepared from Binder C resin. Toners were prepared by melt compounding the ingredients on a two-roll mill, followed pulverizing to approximately 8 microns particle diameter on a Trost model TX jet mill. For each, 46.63 g of Binder C was mixed with 5.63 g of LUPRETON RED SE1255™, obtained from BASF Aktiengesellschaft of Ludwigshafen, Germany and 1 g of BONTRON E-84™ charge agent, obtained from the Orient Corp. of Osaka, Japan. Fumaric acid (Aldrich Chemicals) was also included in amounts 0, 0.1, 0.5 or 2.5 g to make the samples at 0, 0.2, 1.0 and 5.0 pph concentration. LUPRETON RED SE1255™ itself is a mixture of 40% pigment red 57:1 and 60% of a polyester toner resin of similar properties to Binder C. The toners thus contained 50 g total of resin (defined as 100 pph), 2.25 g of magenta pigment (4.5 pph), 1 g of charge agent (2 pph), and 0, 0.2, 1.0 or 5.0 pph of fumaric acid.

Developers were prepared by mixing 8% of the above described toners with 92% of a magnetic carrier material comprised of a strontium ferrite core of about 25 microns average diameter, and a coating of 1.25% of a 60/40 mixture of polyvinylidene fluoride/polymethylmethacrylate. Charge per mass of the developers was measured after each of two separate exercise periods. The first exercise period consisted of vigorously shaking the developer to cause triboelectric charging by placing a 4–7 g portion of the developer into a 4 dram glass screw cap vial, capping the vial and shaking the vial on a "wrist-action" robot shaker operated at about 2 Hertz (Hz) and an overall amplitude of about 11 centimeters (cm) for 2 minutes. This condition was labeled "fresh developer, 2 min shake". The same sample of developer was also subjected to an additional exercise period of 10 minutes on top of a rotating-core magnetic brush. The vial as taken from the robot shaker was constrained to the brush while the magnetic core was rotated at 2000 rpm to approximate actual use of the developer in an electrographic process. Thus, the developer was exercised as if it were directly on a magnetic brush, but without any loss of developer, because it was contained within the vial. Toner charge level after this exercise was designated as "fresh developer 10 min exercise". The toner was then electrostatically removed from the carrier by toning from a magnetic brush onto a metallic cylinder with a bias voltage applied. This carrier was then rebuilt with 8% of fresh toner, and subjected to the same two exercise cycles, with the charge per mass values being measured and labeled as "rebuilt developer 2 min shake" and "rebuilt developer, 10 min exercise".

The toner Q/m ratio was measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture was placed on the bottom metal plate. The sample was then subjected for thirty seconds to a 60 Hz magnetic field and potential of 2000 V across the plates, which causes developer agitation. The toner particles were released from the carrier particles under the combined influence of the magnetic and electric fields and were attracted to and thereby deposited on the upper electrode plate, while the magnetic carrier particles were held on the lower plate. An electrometer measured the accumulated charge of the toner on the upper plate. The toner Q/m ratio in terms of microcoulombs per gram ($\mu$C/g) was calculated by dividing the accumulated charge by the mass of the deposited toner taken from the upper plate.

It is seen in Table 5 that the addition of fumaric acid resulted in a decrease in charge levels. The desirable range of charge was approximately −20 to −60 $\mu$C/g for 8 micron sized toner, it was found that the 10 min exercise condition approximates the running condition of a developer in the toning station of an actual electrophotographic printer. It is thus possible to get the charge in the correct range by adding the appropriate amount of this acidic charging component.

TABLE 5

| Effect of fumaric acid in polyester magenta toner based on Binder C | | | | |
|---|---|---|---|---|
| pph additional fumaric acid | Fresh developer 2 min shake | Fresh Developer 10 min exercise | Rebuilt developer 2 min shake | Rebuilt developer 10 min exercise |
| 0 | −20.2 | −65.8 | −62.2 | −108.1 |
| 0.2 | −4.3 | −54.3 | −10.8 | −64.5 |
| 1.0 | −6.2 | −28.5 | −9.5 | −61.2 |
| 5.0 | −6.5 | −40.4 | −14.3 | −53.9 |

Table 6 describes an example where an acidic charge controlling substance, adipic acid, was tested with and without a metal complex charge agent, Bontron E-84 as before. Toners were prepared with Binder C resin with the method described for the Table 5 examples, with the exception that these toners were prepared without colorant strictly for purposes of simplification. By leaving out a colorant, it was possible to observe via optical microscopy that the added acidic material did not macroscopically phase separate within the toner. Developers were prepared and exercised as described previously, and evaluated for their charge per mass level. It is seen in Table 5 that the charge levels decrease with increasing concentration of adipic acid both with and without Bontron E-84 charge agent being present. However, the overall charge levels are higher and change less (as a percentage) over the varying conditions of exercise with 2 pph of Bontron E-84 versus no Bontron E-84. It is only possible to get the charge level within the useful range of approximately −20 to −60 μC/g by using both charge directing substances.

TABLE 6

Effect of adipic acid with and without second charge agent in clear polyester toner based on Binder C

| pph adipic acid added | Fresh developer 2 min shake | Fresh Developer 10 min exercise | Rebuilt developer 2 min shake | Rebuilt developer 10 min exercise |
|---|---|---|---|---|
| 0 pph Bontron E-84 charge agent | | | | |
| 0 | −13.2 | −36.8 | −11.1 | −23.5 |
| 0.2 | −10.0 | −30.1 | −7.1 | −17.3 |
| 1 | −10.1 | −27.6 | −4.6 | −12.5 |
| 5 | −10.4 | −28.4 | −5.3 | −11.6 |
| 2 pph Bontron E-84 charge agent | | | | |
| 0 | −37.6 | −85.1 | −61.0 | −75.9 |
| 0.2 | −29.6 | −64.2 | −39.4 | −49.6 |
| 1 | −30.4 | −41.8 | −17.1 | −32.3 |
| 5 | −18.5 | −35.7 | −11.2 | −29.2 |

In the examples of Table 7, polyester toners based on LLT-101 resin were prepared with varying concentrations of a number of different acids, all at a concentration 2 pph of Bontron E-84 charge agent, and again without colorant for purposes of simplification. The toners were prepared and tested for tribocharging ability by the methods described for the Table 5 examples. LLT-101 resin did not itself contain monomeric acid materials, while the Binder C resin of Tables 5 and 6 contained as supplied by the vendor approximately 0.2 pph of a mixture of fumaric and maleic acids (refer to Table 4). It is seen in Table 7 that the control toner with no added acidic substance charges much higher than the counterpart control toner of Table 6 based on Binder C. It is discerned in Table 7 that in general, the lower the pKa of the acidic additive, the greater the ability of the additive to lower the tribocharge level of the toner. For the diacids, the dissociation constant of the first acid, given by pKa1, is the value to consider. It is seen that many acids are useful in achieving the desired level of −20 through −60 μC/g with 2 pph Bontron E-84 in LLT-101 resin.

TABLE 7

Effect of added acids in low acid value clear polyester toner based on LLT-101 resin, with 2 pph Bontron E-84 charge agent

| pph added acid | Fresh developer 2 min shake | Fresh Developer 10 min exercise | Rebuilt developer 2 min shake | Rebuilt developer 10 min exercise |
|---|---|---|---|---|
| No added acid | | | | |
| 0 | −45.9 | −106.9 | −91.5 | −126.0 |
| Fumaric acid, pKa1 3.0, pKa2 4.4 | | | | |
| 0.2 | −25.0 | −60.1 | −45.5 | −48.3 |
| 1 | −17.6 | −25.4 | −24.9 | −29.8 |
| 5 | −11.6 | −25.1 | −17.5 | −23.1 |
| Adipic acid, pKa1 4.5, pKa2 5.4 | | | | |
| 0.2 | −25.9 | −63.2 | −56.9 | −57.7 |
| 1 | −23.7 | −40.9 | −27.1 | −28.8 |
| 5 | −18.6 | −25.8 | −17.9 | −24.5 |
| Maleic acid, pKa1 2.0, pKa2 6.2 | | | | |
| 0.2 | −42.6 | −99.1 | −78.8 | −96.4 |
| 1 | −2.6 | −26.0 | −5.1 | −15.7 |
| 5 | bicharged | −2.4 | bicharged | −2.7 |
| Terephthalic acid, pKa1 3.5, pKa2 4.4 | | | | |
| 0.2 | −30.3 | −37.2 | −43.9 | −35.6 |
| 1 | −34.9 | −19.7 | −15.2 | −12.9 |
| 5 | −32.8 | −10.0 | −18.2 | −5.8 |

TABLE 7-continued

Effect of added acids in low acid value clear polyester toner based on LLT-101 resin, with 2 pph Bontron E-84 charge agent

| pph added acid | Fresh developer 2 min shake | Fresh Developer 10 min exercise | Rebuilt developer 2 min shake | Rebuilt developer 10 min exercise |
|---|---|---|---|---|
| Isophthalic acid, pKa1 3.6, pKa2 4.6 | | | | |
| 0.2 | −34.9 | −62.2 | −62.6 | −53.4 |
| 1 | −23.1 | −19.6 | −17.3 | −12.3 |
| 5 | −16.2 | −8.9 | −5.7 | −5.7 |
| Lauric acid | | | | |
| 0.2 | −40.9 | −96.0 | −83.5 | −110.1 |
| 1 | −52.5 | −125.5 | −114.0 | −123.0 |
| 5 | −8.7 | bicharged | −12.1 | −6.2 |

Table 8 describes examples where acidic materials are added to clear toner based on Binder C containing 2 pph Bontron E-84 charge agent. Thus, for these examples, the toners contained a mixture of small molecule acids, the material of the examples added at the stated series of concentrations, plus the 0.2% of the fumaric acidimaleic acid mixture in the as received resin. It is seen again in Table 8 that in general, the lower the pKa of the acidic additive, the lower the tribocharging value. For example, oxalic acid had the lowest pKa1 of the set, and by 1 pph results in the reduction of the charging properties of the toner so much that the developers were now bicharged. Bicharged developer contained toner of both polarities, and was useless in preparing high quality images. The trend of decreasing charge with decreasing pKa was seen very clearly among the set of para substituted benzoic acids at the end of the table. It is seen that it was possible to prepare toner that functions within the useful range of tribocharge of −20 through −60 $\mu$C/g with 2 pph Bontron E-84 in Binder C resin, by adding the correct amount of an appropriate acidic charge additive.

TABLE 8

Effect of added acids in high acid value clear polyester toner based on Binder C resin, with 2 pph Bontron E-84 charge agent, on charge values in $\mu$C/g.

| pph added acid | Fresh developer 2 min shake | Fresh Developer 10 min exercise | Rebuilt developer 2 min shake | Rebuilt developer 10 min exercise |
|---|---|---|---|---|
| No added acid | | | | |
| 0 | −37.6 | −85.1 | −61.0 | −75.9 |
| Fumaric acid, pKa1 3.0, pKa2 4.4 | | | | |
| 0.2 | −27.7 | −47.5 | −25.9 | −34.8 |
| 1 | −18.0 | −30.5 | −15.3 | −22.1 |
| 5 | −12.8 | −30.4 | −14.6 | −22.7 |
| Salicylic acid, pKa 3.0 | | | | |
| 0.2 | −22.7 | −65.5 | −46.5 | −62.0 |
| 1 | −21.0 | −50.5 | −25.5 | −46.5 |
| 5 | −17.4 | −41.1 | −17.0 | −42.8 |
| Maleic acid, pKa1 2.0, pKa2 6.2 | | | | |
| 0.2 | −28.8 | −79.1 | −55.6 | −65.3 |
| 1 | −4.9 | −19.3 | −2.7 | −9.3 |
| 5 | bicharged | −3.7 | −3.3 | −3.0 |
| Terephthalic acid, pKa1 3.5, pKa2 4.4 | | | | |
| 0.2 | −25.5 | −58.9 | −45.3 | −49.8 |
| 1 | −24.4 | −46.9 | −34.4 | −37.9 |
| 5 | −28.3 | −13.8 | −16.5 | −13.3 |
| Isophthalic acid, pKa1 3.6, pKa2 4.6 | | | | |
| 0.2 | −23.4 | −48.7 | −33.9 | −38.1 |
| 1 | −16.9 | −33.7 | −26.5 | −26.3 |
| 5 | −16.3 | −14.9 | −7.7 | −8.9 |
| Lauric acid | | | | |
| 0.2 | −44.3 | −88.1 | −60.1 | −77.5 |
| 1 | −43.7 | −104.5 | −69.6 | −90.8 |
| 5 | −14.7 | bicharged | −35.0 | bicharged |
| Oxalic acid, pKa1 1.3, pKa2 4.3 | | | | |
| 0.2 | −17.4 | −69.7 | −44.0 | −59.2 |
| 1 | −2.5 | bicharged | bicharged | bicharged |

TABLE 8-continued

Effect of added acids in high acid value clear polyester toner based on Binder C resin, with 2 pph Bontron E-84 charge agent, on charge values in μC/g.

| pph added acid | Fresh developer 2 min shake | Fresh Developer 10 min exercise | Rebuilt developer 2 min shake | Rebuilt developer 10 min exercise |
|---|---|---|---|---|
| 5 | bicharged | bicharged | bicharged | bicharged |
| Glutaric acid, pKa1 4.3, pKa2 5.4 | | | | |
| 0.2 | −26.5 | −66.2 | −45.7 | −58.1 |
| 1 | −16.6 | −42.5 | −15.6 | −30.1 |
| 5 | −6.2 | −11.8 | −4.5 | −13.3 |
| Azelaic acid, pKa1 4.5, pKa2 5.4 | | | | |
| 0.2 | −33.0 | −64.6 | −47.8 | −63.3 |
| 1 | −31.6 | −54.5 | −33.3 | −45.0 |
| 5 | −15.1 | −25.6 | −8.1 | −25.9 |
| Itaconic acid | | | | |
| 0.2 | −20.6 | −63.1 | −41.3 | −49.7 |
| 1 | −13.6 | −33.7 | −10.2 | −22.6 |
| 5 | −11.9 | −24.1 | −6.4 | −18.7 |
| 4-nitrobenzoic acid, pKa 3.4 | | | | |
| 0.2 | −24.9 | −37.8 | −48.8 | −53.9 |
| 1 | −8.1 | bicharged | −3.8 | −1.8 |
| 5 | bicharged | bicharged | bicharged | −6.3 |
| 4-hydroxybenzoic acid, pKa 3.7 | | | | |
| | −25.3 | −61.1 | −55.3 | −57.1 |
| | −23.4 | −51.4 | −33.1 | −46.8 |
| | −21.2 | −29.2 | −21.3 | −25.1 |
| 4-chlorobenzoic acid, pKa 4.0 | | | | |
| | −30.0 | −55.9 | −53.3 | −57.2 |
| | −23.6 | −10.3 | −39.9 | −37.4 |
| | −15.8 | −3.1 | −22.6 | −24.2 |
| 4-aminobenzoic acid, pKa 4.9 | | | | |
| | −35.3 | −78.1 | −63.2 | −72.1 |
| | −40.0 | −84.8 | −56.8 | −67.7 |
| | −36.9 | −71.6 | −42.6 | −60.5 |

Table 9 contains the results of developer life experiments with toners based on resins of varied acid concentration. The description of the resins used is found in Table 4. Black and magenta colored toners were prepared by melt compounding on a Werner and Pfleiderer model ZSK-30 twin-screw extruder, and jet mill pulverizing to approximately 8 microns volume average diameter on a Hosakawa-Alpine Model 200AFG. The resulting toner powders were then surface treated with R972 fumed hydrophobized silica, obtained from the Degussa Corporation of Akron, Ohio, in a Henschel FM75 high energy dry mixer. The colorant in the magenta toners comprised pigment red 57:1 added via a 40% concentrate in polyester resin, LUPRETON RED SE1255™, obtained from BASF Aktiengesellschaft of Ludwigshafen, Germany, the colorant in the black toners comprised Regal 330 carbon black obtained from Cabot Corporation. All of the toners contained BONTRON E-84™ charge agent, obtained from the Orient Corp. of Osaka, Japan; BONTRON E-84™ is the aluminum salt or complex of three di-tertbutyl salicylic acid ligands. Developers were prepared at 6% toner concentration, on a strontium ferrite carrier coated with 1.25% of a 60/40 mixture of polyvinylidene fluoride/polymethylmethacrylate, as described previously.

Developer aging experiments were conducted on life test fixture devices. The life test fixture comprises a toning station similar to that disclosed in U.S. Pat. No. 4,473,029, the teachings of which are incorporated herein in the entirety by reference. The toning station has a mixing sump with magnetic toner concentration monitor, feed mechanism (transport roller or bucket brigade plus feed skive), rotating core and shell toning roller, and toner replenishment unit. Toner was taken out continuously by bias development onto a metal drum, from which it was removed by a blade cleaning mechanism. As toner was depleted from the station, the magnetic monitor and control circuitry added replenisher toner such that the toner concentration in the sump was held constant. The rate of takeout was controlled by the bias development voltage. Charge per mass was measured off-line by the MECCA method described previously. The charge measurements reported in Table 6 are averages of values taken over the last 5 hours of each test.

In the first set of experiments with black toner, it was seen that the charge level decreased from −112 to −80 to −54 μC/g, as the monomeric acid level of the toner resin goes from 0.01% to 0.06% to 0.2%, for resins Binder I, Binder A and Binder C, respectively. These results are consistent with the results from Tables 5 through 8, where the toners did not have the silica surface treatment in place. It should also be noted that in general, increasing silica concentration also caused an increase in the negative charge level. It was seen that a certain level of small molecule acid was necessary to get the tribocharge level in the appropriate range of approximately −20 through −60 μC/g. It was also seen that the acid value of the resin was not the controlling factor in determining charge level, as the highest charging toner based on Binder I has the highest charge, but rather that it was the level of small molecule acid that was dominant.

In the second set of experiments in Table 9, magenta toners were prepared from a series of blends of Binder C with resin LLT-101. As the level of monomeric acidic material goes from very low (below the GC detection limit) for LLT-101 to 0.2% for Binder C, the charge drops monotonically. The effect of monomeric acid was the same as observed previously.

In the set of experiments in Table 9, magenta toners were prepared with Binder C, 0.7% R972 silica, with 1, 2 or 3 pph E-84 charge agent. The higher the concentration of E-84, the higher the charge level at the end of the test, however the slope of the charge controlling effect was less steep than that due to small molecule acid additives. In addition, all three tests started at a charge level of about −35 μC/g, with the charge decreasing for 1 pph E-84, staying approximately level for 2 pph E-84, and rising slightly for 3 pph E-84. It appears that the E-84 charge agent can be used to get a sustained level of charge, while the acid additive can be used to control the level of charge over a wide range. It should be noted that for this last set of life test fixture runs, the tribocharge level was measured using an ET device as opposed to the MECCA device used for the previous data; the ET device was known to yield higher Q/M values than the MECCA device. The magnetic field is supplied by a 60 Hz coil in the MECCA unit, while the ET employs a rotating permanent magnet setup, otherwise the charge per mass of the toner is measured as described previously.

TABLE 9

Life test fixture results for resins of varying acid content

| Resin | Comment | % R972 silica | Q/M (μC/g) average at end of test |
|---|---|---|---|
| 40 hour tests | | | |
| Binder C | Black toner, 2 pph E-84 | 1.2% | −54 |
| Binder A | Black toner, 2 pph E-84 | 1.2% | −80 |
| Binder I | Black toner, 2 pph E-84 | 1.2% | −112 |
| Binder C/LLT-101 | | | |
| 60 hour tests | | | |
| 100/0 | Magenta toner, 2 pph E-84 | 0.7% | −30 |
| 75/25 | Magenta toner, 2 pph E-84 | 0.7% | −36 |
| 50/50 | Magenta toner, 2 pph E-84 | 0.7% | −40 |
| 25/75 | Magenta toner, 2 pph E-84 | 0.7% | −63 |
| 0/100 | Magenta toner, 2 pph E-84 | 0.7% | −77 |
| Magenta toner, charge measurements by ET, 40 hour tests | | | |
| Binder C | 1 pph E-84 charge agent | 0.7% | −27 |
| Binder C | 2 pph E-84 charge agent | 0.7% | −36 |
| Binder C | 3 pph E-84 charge agent | 0.7% | −41 |

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A toner formulation comprising at least one toner resin, at least one first charge control agent capable of providing a consistent or controllable level of charge, at least one second charge control agent capable of providing a sustained level of charge, and optionally at least one surface treatment agent, and optionally at least one release agent, and optionally at least one colorant, wherein said first charge control agent comprises at least one acidic organic charge control agent and said second charge control agent comprises at least one organo metal complex.

2. The toner formulation of claim 1, wherein said at least one release agent is present.

3. The toner formulation of claim 1, wherein said first charge control agent provides a consistent level of charge of from about −10 to about −30 micro C/gm.

4. The toner formulation of claim 3, wherein said toner formulation comprises toner particles which have a particle size of from about 10 microns to about 12 microns.

5. The toner formulation of claim 1, wherein said second charge control agent provides a sustained level of charge of from about −10 to about −30 micro C/gm for a time of from about 2 minutes to about 10 minutes.

6. The toner formulation of claim 5, wherein said toner formulation comprises particles having a particle size of from about 10 microns to about 12 microns.

7. The toner formulation of claim 1, wherein said first charge control agent provides a consistent level of charge of from about −10 to about −30 micro C/gm, and said second charge control agent provides a sustained level of charge of from about −10 to about −30 micro C/gm for a time of from about 2 minutes to about 10 minutes.

8. The toner formulation of claim 7, wherein said toner formulation comprises particles having a particle size of from about 10 microns to about 12 microns.

9. The toner formulation of claim 1, wherein said first charge control agent provides a consistent level of charge of from about −30 to about −120 micro C/gm.

10. The toner formulation of claim 9, wherein said toner formulation comprises particles having a particle size of from about 4 microns to about 8 microns.

11. The toner formulation of claim 1, wherein said second charge control agent provides a sustained level of charge of from about −30 to about −120 micro C/gm for a time of from about 2 minutes to about 10 minutes.

12. The toner formulation of claim 11, wherein said toner formulation comprises particles having a particle size of from about 4 microns to about 8 microns.

13. The toner formulation of claim 1, wherein said first charge control agent provides a consistent level of charge of from about −30 to about −120 micro C/gm, and said second charge control agent provides a sustained level of charge of from about −30 to about —120 micro C/gm for a time of from about 2 minutes to about 10 minutes.

14. The toner formulation of claim 13, wherein said toner formulation comprises particles having a particle size of from about 4 microns to about 8 microns.

15. The toner formulation of claim 1, wherein said first charge control agent is an acidic organic charge control agent and said second charge control agent is an organo iron complex charge control agent.

16. The toner formulation of claim 1, wherein said surface treatment agent is present and comprises silica.

17. The toner formulation of claim 1, wherein said surface treatment agent is present and comprises at least one metal oxide.

18. The toner formulation of claim 1, wherein said surface treatment agent is present and comprises at least one inorganic oxide.

19. The toner formulation of claim 1, wherein said surface treatment agent is present and comprises at least one polymeric material.

20. The toner formulation of claim 1, wherein said surface treatment agent is present and comprises acrylic polymer, silicone-based polymer, styrenic polymer, fluoropolymer, or mixtures thereof.

21. The toner formulation of claim 1, wherein said surface treatment agent is present in an amount of from about 0.05 to about 5.0 weight percent, based on the weight of the toner.

22. The toner formulation of claim 2, wherein said release agent comprises at least one wax.

23. The toner formulation of claim 22, wherein said wax comprises at least one polyolefin wax.

24. The toner formulation of claim 1, further comprising at least one magnetic material.

25. A development system for toner comprising:

a supply of dry developer mixture comprising the toner particles of claim 1 and bard magnetic carrier particles;

a non-magnetic, cylindrical shell for transporting the developer from said supply to a development zone, wherein said shell is rotatable or stationary;

a rotating magnetic core of a pre-selected magnetic field strength;

means for rotating at least said magnetic core to provide for the transport of said toner particles from said shell to an electrostatic image.

26. The development system of claim 25, wherein said toner particles have a spacing agent on the surface of said toner particles.

27. The development system of claim 26, wherein said spacing agent comprises silica.

28. The development system of claim 26, wherein said spacing agent comprises at least one metal oxide.

29. The development system of claim 26, wherein said spacing agent comprises at least one inorganic oxide.

30. The development system of claim 26, wherein said spacing agent comprises at least one polymeric material.

31. The development system of claim 26, wherein said spacing agent comprises acrylic polymer, silicone-based polymer, styrenic polymer, fluoropolymer, or mixtures thereof.

32. The development system of claim 26, wherein said spacing agent is present in an amount of from about 0.05 to about 5.0 wt %, based on the weight of the toner.

33. A method for developing an electrostatic image with the toner of claim 1 comprising developing an electrostatic image member beating an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which is rotating or stationary, and controlling the directions and speeds of the core and optionally the shell rotations so that developer flows through the development zone in a direction co-current with the image member movement, wherein said developer comprises charged toner particles of claim 1 and oppositely charged hard magnetic carrier particles.

34. The method of claim 33, wherein said method has a developer flow, and said moving imaging member and said developer flow are moving at substantially the same speed.

35. The method of claim 33, wherein said carrier particles comprise hard magnetic material exhibiting a coercivity of at least about 300 gauss when magnetically saturated and also exhibit an induced magnetic moment of at least about 20 EMU/gm when in an externally applied field of 1,000 gauss.

36. The method of claim 33, wherein said toner particles comprise a spacing agent on the surface of said toner particles.

37. The method of claim 36, wherein said spacing agent comprises silica.

38. The method of claim 36, wherein said spacing agent comprises at least one metal oxides.

39. The method of claim 36, wherein said spacing agent comprises at least one inorganic oxide.

40. The method of claim 36, wherein said spacing agent comprises at least one polymeric material.

41. The method of claim 36, wherein said spacing agent comprises acrylic polymer, silicone-based polymer, styrenic polymer, fluoropolymer, or mixtures thereof.

42. The method of claim 36, wherein said spacing agent is present in an amount of from about 0.05 to about 5.0 wt %, based on the weight of the toner.

43. A developer comprising the toner formulation of claim 1 and carrier particles.

44. The toner formulation of claim 1, wherein said first charge control agent is present in an amount of from about ½ part to about 3 parts per 100 parts of toner resin, said second charge control agent is present in an amount of from about ½ part to about 3 parts per 100 parts of toner resin.

45. A method to decrease ruboff in a printed image comprising developing an electrostatic image with a toner formulation of claim 1.

46. The method of claim 45, wherein said printed image has a 3 PSI ruboff value of from about 3 to about 14.

47. The method of claim 46, wherein said 3 PSI ruboff value is from about 4 to about 7.

48. The toner formulation of claim 1, wherein an image developed with said toner formulation has a 3 PSI rub-off value of from about 3 to about 14.

49. The toner formulation of claim 48, wherein said toner formulation has a triboelectric charge of from about −10 to −30 micro C/gm.

50. The toner formulation of claim 48, wherein said toner formulation has a toner throw-off in a developer of about 10 mg or less.

51. The toner formulation of claim 1, wherein said first charge control agent comprises 2,4-dihydro-5-methyl-2-phenyl-3H-pyrazol-3-one or derivatives thereof and said second charge control agent comprises an organo iron complex.

52. The toner formulation of claim 1, wherein said first charge control agent comprises materials with one or more acidic functional groups.

53. The toner formulation of claim 1, wherein said first charge control agent is 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived therefrom.

54. The toner formulation of claim 1, wherein said first charge control agent is fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid and combinations thereof.

55. The toner formulation of claim 1, wherein said toner resin comprises a polyester.

56. The toner formulation of claim 1, wherein said toner resin comprises a polyester synthesized from a bisphenol diol and a polycarboxylic acid, said first charge control agent comprises at least one acidic organic charge control agent, said second charge control agent comprises a metal salt of salicylic acid or a derivative thereof.

* * * * *